United States Patent [19]

Matey

[11] Patent Number: 4,466,309

[45] Date of Patent: Aug. 21, 1984

[54] ADJUSTABLY POSITIONED HANDGRIP FOR AMBULATORY AIDS

[75] Inventor: Edward J. Matey, Sussex, N.J.

[73] Assignee: Maddak, Inc., Pequannock, N.J.

[21] Appl. No.: 365,567

[22] Filed: Apr. 5, 1982

[51] Int. Cl.[3] ..... B62K 21/26

[52] U.S. Cl. ..... 74/551.9; 16/111 R; 16/114 R

[58] Field of Search ..... 74/551.9, 557, 543; 74/548, 558.5, 560; 135/68; 5/445; 294/57; 16/111 R, 114 R, D12, D24; 403/344; 248/118, 230

[56] References Cited

U.S. PATENT DOCUMENTS

| | | | |
|---|---|---|---|
| 867,498 | 10/1907 | Gilbert | 403/344 |
| 1,505,081 | 8/1924 | Arndt | 135/68 |
| 1,730,820 | 10/1929 | Holden | 16/D12 |
| 2,151,449 | 3/1939 | Steinen | 16/114 |
| 2,231,222 | 2/1941 | Rosenhiemer, Jr. | 16/D12 |
| 2,388,778 | 11/1945 | Wheeler | 135/68 |
| 2,425,245 | 8/1947 | Johnson | 24/551.9 |
| 2,488,309 | 11/1949 | Mason | 403/344 |
| 3,046,040 | 7/1962 | Luper | 248/230 |
| 3,300,250 | 1/1967 | Dollgener et al. | 248/118 |
| 3,995,650 | 12/1976 | Divito | 24/551.9 |
| 4,089,497 | 5/1978 | Miller et al. | 248/118 |
| 4,197,611 | 4/1980 | Bell et al. | 16/D12 |
| 4,331,360 | 5/1982 | Roudybush et al. | 248/118 |

FOREIGN PATENT DOCUMENTS

| | | |
|---|---|---|
| 2260324 | 7/1975 | France . |
| 1441640 | 7/1976 | United Kingdom . |

*Primary Examiner*—Kenneth Dorner
*Assistant Examiner*—Anthony W. Raskob, Jr.
*Attorney, Agent, or Firm*—Anthony F. Cuoco

[57] ABSTRACT

An adjustably positioned handgrip for ambulatory aids and the like is disclosed which is contoured for maintaining the hand of the user relatively open and comfortably positioned thereon, and for reducing the tendency of the hand to slide away from and off the grip. The handgrip is adjustably mounted on the ambulatory aid to permit its displacement relative thereto to accommodate the particular needs of the user.

6 Claims, 9 Drawing Figures

ADJUSTABLY POSITIONED HANDGRIP FOR AMBULATORY AIDS

BACKGROUND OF THE INVENTION

Handgrips for ambulatory aids such as canes, crutches, invalid walkers and the like must be designed with maximum safety, comfort and therapeutic support of the user in mind. To this end the handgrip must be contoured to enhance hand comfort and positioning and to prevent the hand from sliding off the grip. Moreover, the handgrip must be adjustable to at least several positions relative to the ambulatory aid to accommodate particular needs of the user. Finally, the handgrip must be adapted to facilitate mounting and positioning on the ambulatory aid. In these respects the handgrip to be herein described is an improvement over handgrips for like purposes now known in the art such as, for purposes of illustration, that described and claimed in U.S. Pat. No. 3,995,650 issued on Dec. 7, 1976 to Fred Devito and assigned to Lumex, Inc.

SUMMARY OF THE INVENTION

This invention contemplates a handgrip for ambulatory aids and the like which may be of right and left hand configurations. The grip is contoured whereby the user may keep the hand relatively open and comfortably positioned on the grip while minimizing the tendency of the hand to slide off and away therefrom as the ambulatory aid is used. The grip is adjustably positioned relative to the ambulatory aid to further enhance its adaptability to the particular needs of the user. To these ends the novel handgrip described herein features an elongated contoured shell. An adapter fits within the shell, with the shell being coupled through the adapter to an ambulatory aid member. The shell and adapter are arranged so that the shell is angularly displaceable on the ambulatory aid member from one position to at least another position, to accommodate optimum grasping therof by the user.

Accordingly, it is the object of this invention to provide an improved handgrip for ambulatory aids which is adjustably coupled to the ambulatory aid and is directed toward maximum user comfort, safety and therapeutic value.

DETAILED DESCRIPTION OF THE INVENTION

Figure 3:
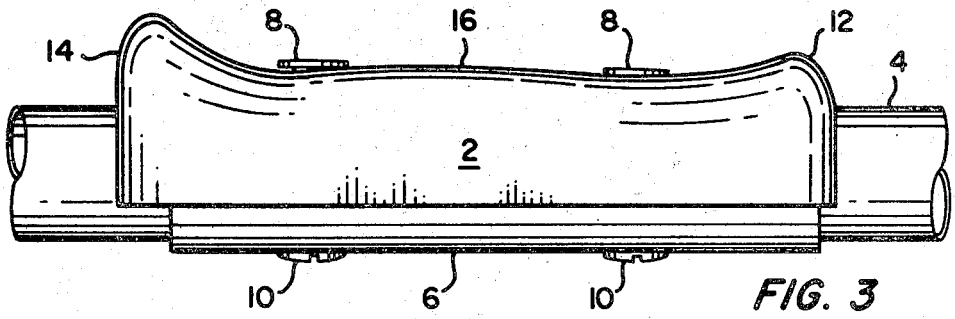
FIG. 3 is a side view of the handgrip of the invention, and wherein the handgrip is shown in conjunction with the ambulatory aid member 4 and an adapter 6.

With reference to the Drawing, wherein corresponding elements carry corresponding numerical designations, and first with particular reference to FIG. 3, the adjustably positioned handgrip for ambulatory aids to be herein described includes an elongated contoured shell member 2 coupled to an ambulatory aid member 4 through an adapter 6. Shell 2 and adapter 6 are secured to ambulatory aid member 4 through threaded bushings 8 which receive screws 10.

Figure 1:
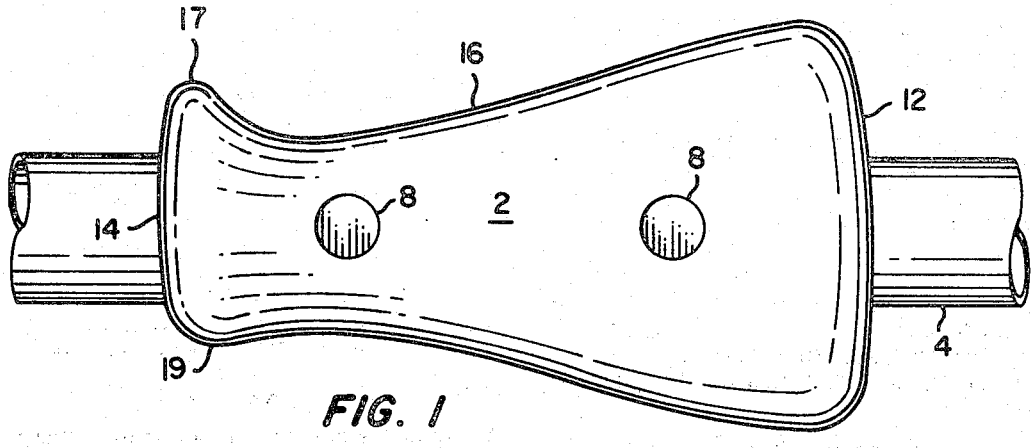
FIG. 1 is a top plan view of the handgrip of the invention in a right hand configuration, and wherein the handgrip is shown in conjunction with an ambulatory aid member 4.

With particular reference to FIG. 1, wherein the handgrip is shown in a right hand configuration, shell 2 is seen as tapering in a smooth curve from a relatively wide end 12 to a relatively narrow end 14. Wide end 12 and narrow end 14 are separated by an intermediate section 16. Bushings 8 are disposed in intermediate section 16.

With reference again to FIG. 3, shell 2 is longitudinally contoured so that wide end 12 is curved slightly higher than intermediate section 16 and narrow end 14 is curved substantially higher then intermediate section 16 and wide end 12. Intermediate section 16 has a slight longitudinal bulge and shell 2 is transversely concave (FIGS. 4 and 5).

As best shown in FIG. 1, narrow end 14 terminates in a lip 17 extending substantially normal to the axis of shell 2 on one side thereof and in a flare 19 on the other side of the shell.

Figure 4:
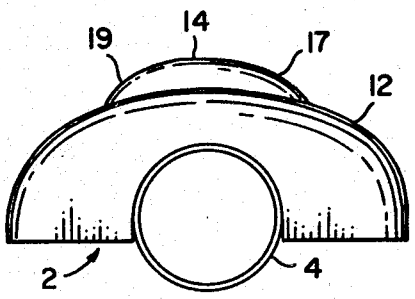
FIG. 4 is a right end view relative to the top plan view of FIG. 1.
Figure 5:
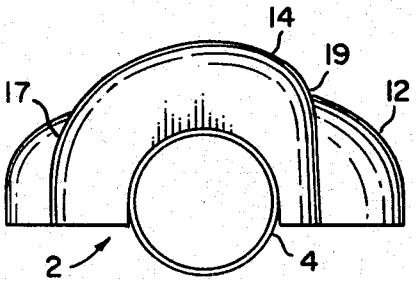
FIG. 5 is a left end view relative to the top plan view of FIG. 1.

As will be seen with particular reference to FIGS. 4 and 5, wide end 12 of shell 2 is substantially symmetrical with ambulatory aid member 4, while narrow end 14 is non-symmetrical thereto by virtue of lip 17 and flare 19.

It will now be understood the wide end 12 of shell 2 is considered to be the back end of the shell while narrow end 14 is considered to be the front end. With this orientation in mind, lip 17 will be understood to extend rightward from the axis of shell 2 in the right hand configuration of FIG. 1. As the user grasps the shell with the right hand, the forefinger of said hand engages lip 17 of narrow end 14, with the thumb engaging flare 19 (see also FIGS. 4 and 5).

Thus, the described contour of shell 2, both transversely and longitudinally, is such that the hand is cradled on intermediate section 16 of shell 2 between the wide and narrow ends 12 and 14 thereof, respectively, to provide a comfortable, relatively open-handed grip across and along the surface of the shell as is desirable and, further, is effective for preventing the hand from sliding off and/or away from the shell as is also desirable.

Figure 2:
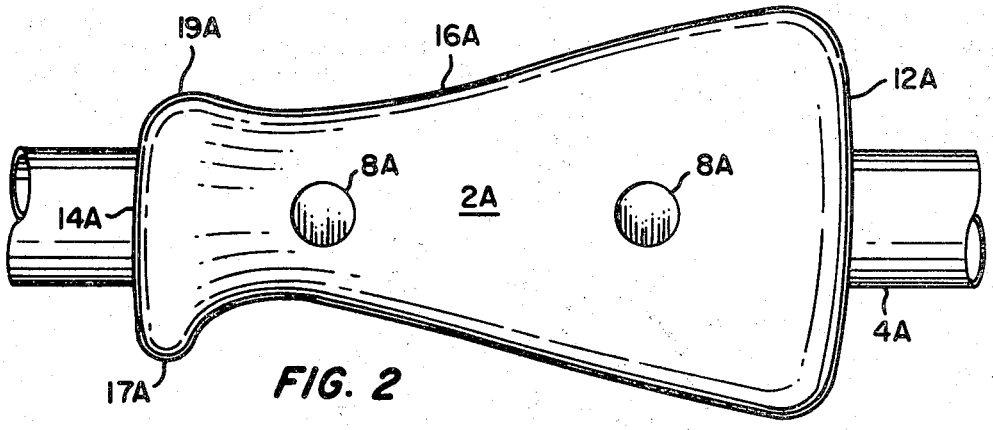
FIG. 2 is a top plan view of the handgrip of the invention in a left hand configuration, and wherein the handgrip is shown in conjunction with the ambulatory aid member 4A.

FIG. 2 is similar to FIG. 1 except that shell 2 is shown in a left hand configuration, and therefore the components shown therein carry the same, numerical designations but with the suffix "A" thereafter.

In comparing the right hand configuration as shown in FIG. 1 to the left hand configuration as shown in FIG. 2, it will be realized that when shell 2A is grasped with the left hand, the forefinger of the hand engages lip 17A of narrow end 14A, and which lip extends leftward from the axis of shell 2A and the thumb engages flare 19A, with the hand cradleing affect being the same as heretofore described.

With the noted distinctions between the right and left hand shell configurations in mind, the remaining description of the invention is applicable to both configurations as will now be understood with reference to the Drawing. However, for purposes of illustration reference will hereinafter be made to shell 2.

Figure 6:
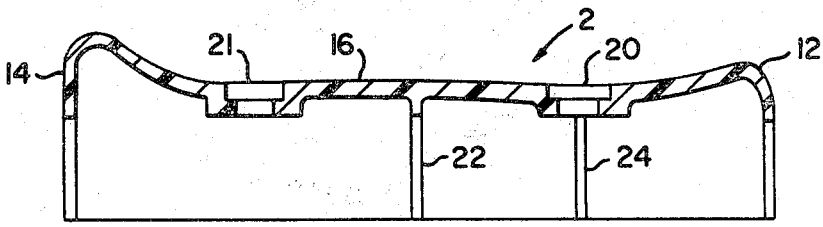
FIG. 6 is a sectional side view of an elongated handgrip shell 2.

With specific reference to FIG. 6, a sectional view of shell 2 is shown. In this regard, shell 2 is a rigid member molded of a suitable plastic material such as polyethylene to the described contoured configuration. The shell includes a pair of counter sunk holes 20, 21, disposed in longitudinally spaced relation along intermediate section 16, and which receive bushings 8. The shell further includes a pair of internal ribs 22 and 24 in longitudinally spaced relation for purposes which will hereinafter be described with reference to FIG. 9.

Figure 7:
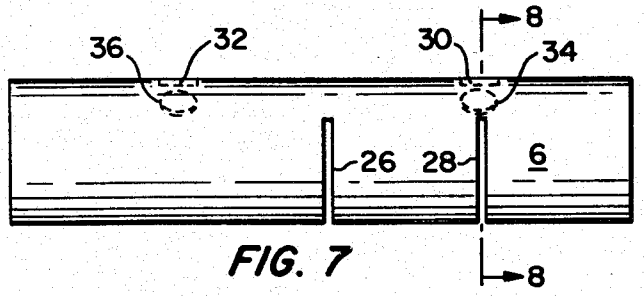
FIG. 7 is a side view of adapter 6 shown in FIG. 3.
Figure 8:
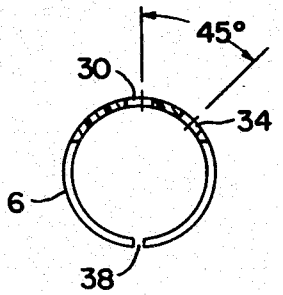
FIG. 8 is a partially sectioned right end view taken along the lines 8—8 in FIG. 7.

Reference is now made to FIGS. 7 and 8 wherein adapter 6 is shown. Adapter 6 is a flexible tubular like member which is molded of a suitable flexible plastic material such as polyethylene. Adapter 6 has a pair of transverse slots 26 and 28 in longitudinally spaced relation and extending partially through the adapter. The spacing of slots 26 and 28 corresponds to the spacing of shell ribs 22 and 24 for purposes to be hereinafter described.

As particularly shown in FIG. 8, adapter 6 has a slot 38 extending along the entire length thereof so that the radial sides of the adapter may be spread apart as is required for assembly, and as will also be hereinafter described.

Adapter 6 carries a pair of holes 30 and 32 in longitudinally spaced relation which extend through the adapter, and carries a pair of holes 34 and 36 in like spaced relation also extending through the adapter. Holes 30 and 34 are angularly displaced from each other by, for example 45 degrees (See FIG. 8) as are holes 32 and 36. The longitudinally spaced relation of holes 30, 32 and 34, 36 corresponds to that of holes 20 and 21 in shell 2. As will be hereinafter described, the purpose of the angularly displaced holes is to permit rotation of adapter 6 and shell 2 about ambulatory aid member 4 as is an important feature of the invention.

With the components of the invention described with references to FIGS. 1–8, the interrelation of said components and hence the assembly of the handgrip of the invention will now be described with reference to FIG. 9.

Ambulatory aid member 4 may be a tubular member of a metallic material such as aluminum, and as heretofore noted may be the handle of a cane or a crutch or a supporting member of an invalid walker, as the case may be. Ambulatory aid member 4 carries through holes 40 and 42 in longitudinally spaced relation and carries other through holes 44 and 46 in corresponding spaced relation. The spaced relation of holes 40, 42 and 44, 46 corresponds to that of adapter holes 30, 32 and 34, 36 and shell holes 20, 21. Holes 44 and 46 are also displaced 45 degrees from holes 40 and 42 to permit the aforenoted rotation of shell 2 relative to ambulatory aid member 4.

With the above in mind, ambulatory aid member 4 is slipped into slotted adapter 6 so that the adapter with slot 38 on top, surrounds the ambulatory aid member and adapter holes 30, 32 and 34, 36 are aligned with ambulatory aid member holes 40, 42, 44, 46 respectively. In this connection it will be understood that, as previously described, adapter 6 is a flexible plastic member and is diametrically sized so that as ambulatory aid member 4 is inserted into the adapter, the radial sides of the slotted adapter spread to accommodate easy insertion of the ambulatory aid member therein, with the adapter thereafter hugging the ambulatory aid member as will now be understood.

Shell 2 is disposed over the adapter, with holes 20 and 21 therein being aligned with previously aligned adapter holes 30, 32 and ambulatory aid member holes 40, 42, for example. In this connection it is noted that slot 38, spreads upon the assembly of adapter 6 over ambulatory aid member 4 as heretofore noted so that the slot clears shell holes 20 and 21 to permit insertion of bushings 8 (FIG. 9). Ribs 22 and 24 in shell 2 are disposed within transverse slots 26 and 28 in adapter 6. Thus, the disposition of the ribs in the transverse slots serves the purpose of locating the shell over the ambulatory aid member and adapter, with the holes in the proper alignment as aforenoted.

It will now be understood that plastic adapter 6 serves a further purpose and this is to prevent the hand of the user from contacting a metallic member such as ambulatory aid member 4 directly as might be aesthetically objectionable.

In this connection it is to be noted that although in the preferred embodiment of the invention adapter 6 is used, the use of the adapter is not absolutely necessary for the operation of the invention. That is to say, the invention would work without the aforenoted locating and aesthetic features of the adapter, with shell 2 thereupon directly receiving ambulatory aid member 4, with reference being therefore made to FIGS. 4 and 5 wherein adapter 6 is not shown.

Figure 9:
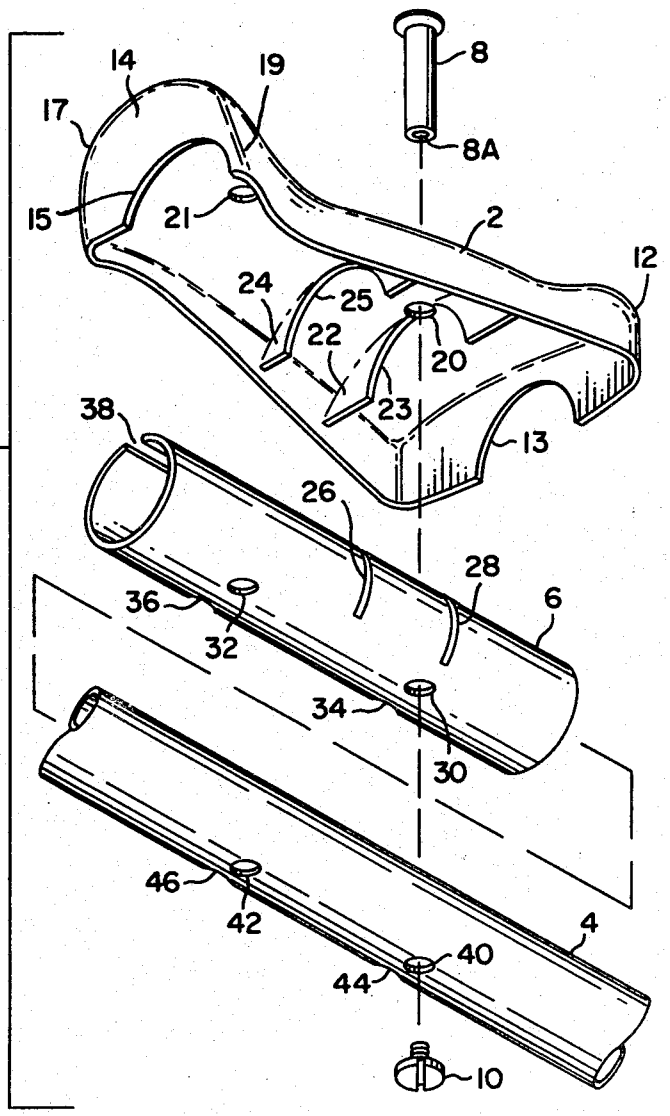
FIG. 9 is an exploded view illustrating in isometric configuration the elements of the handgrip of the invention and further illustrating the assembly of said elements, each to the other.

With ambulatory aid member 4 inserted within adapter 6 and shell 2 disposed over the adapter, bushings 8, only one of which is shown in FIG. 9, are inserted through aligned counterbored shell holes 20, 21; adapter holes 30, 32; and ambulatory aid member holes 40,42. Bushings 8 carry threaded bores 8A which receive screws 10, only one of which is shown in FIG. 9, to secure shell 2, adapter 6, ambulatory aid member 4 each to the other as will now be seen from FIG. 9.

If, for purposes of convenience or as required by the user and to achieve a more comfortable hand position, it is desired that the position of shell 2 relative to ambulatory aid member 4 be displaced, it is merely necessary to dissemble the handgrip and rotate shell 2 by 45 degrees so that holes 20, 21 in the shell are aligned with adapter holes 34, 36 and ambulatory aid member holes 44, 46. Although only two positions of shell 2 have been described, it will be understood that more positions may be desirable and appropriately spaced holes in adapter 6 and ambulatory aid member 4 may be provided therefor.

With continued reference to FIG. 9 and with specific reference to shell 2, it will be seen that ends 12 and 14 of shell 2 have semi-circular openings 13 and 15, respectively, and shell ribs 22 and 24 have openings 23 and 25 aligned with end openings 13 and 15, rspectfully. Openings 13, 15 and 23, 25 cooperate to form a channel which receives ambulatory aid member 4. In this connection it is noted that the length of adapter 6 is shorter than the space between openings 13 and 15, and hence the adapter is received in a channel formed by openings 23 and 25 alone. If the adapter is not used, ambulatory aid member 4 is received in the channel formed by openings 13, 15 and 23, 25.

There has thus been described a handgrip which accommodates optimal hand support and user comfort while permitting the hand to be relatively open. The handgrip is contoured so that body weight of the user is spread over a wider area thus minimizing pressure points, which will be recoognized as desirable. Further, the contour of the handgrip helps prevent hand slippage and provides for a comfortable finer resting position, as is also desirable. The adjustable feature of the handgrip enhances its comfort and ease of use and renders it adaptable to a variety of users.

Having thus described the invention, what is claimed is:

1. A handgrip for gripping an ambulatory aid member and the like, comprising:

an elongated rigid, substantially concave shell which is longitudinally and transversely contoured for gripping, whereby a user's gripping hand is relatively open, said shell having opposite ends separated by an intermediate section and having openings therein which are aligned with each other, said ends and intermediate section cooperating for providing an external cradle for the gripping hand to minimize sliding thereof away from and off the shell, and for providing an internal channel for the ambulatory aid member;

a pair of holes carried by the shell in longitudinally spaced relation;

the ambulatory aid member carrying at least first and second pairs of holes, the holes in each pair being in longitudinally spaced relation corresponding to that of the shell holes and each pair of ambulatory aid member holes being angularly displaced from the other pair;

the shell being angularly displaced relative to the ambulatory aid member for selectively aligning one of the pairs of ambulatory aid member holes with the pair of shell holes, the shell having at least two internal ribs in spaced relation along the length thereof, said ribs having openings which are aligned with the openings in the opposite ends of the shell, said openings in the opposite shell ends and in the internal ribs cooperating to provide the internal channel for receiving the ambulatory aid member;

means for engaging the aligned holes to secure the shell to the ambulatory aid member;

an adapter which fits over the ambulatory aid member and into a channel formed by the openings in the internal ribs, said adapter carrying at least third and fourth pairs of holes, the holes in each of said pairs corresponding in longitudinally spaced relation to the shell holes and the ambulatory aid member holes, and each of the pairs of adapter holes corresponding in angular displacement to that of the pairs of ambulatory aid member holes;

the pairs of adapter holes being aligned with corresponding pairs of ambulatory air member holes and the shell being angularly displaced for selectively aligning one of the pairs of ambulatory air member holes and a corresponding pair of adapter holes with the pair of shell holes;

the engaging means engaging the aligned shell, ambulatory aid member and adapter holes to secure the adapter, ambulatory aid member and shell to each other;

the adapter having at least two transverse slots corresponding in spaced relation along the length thereof to the spaced relation of the internal shell ribs; and the ribs engaging the adapter slots when the adapter fits over the ambulatory aid member and into the channel formed by the openings in the internal ribs.

2. A handgrip as described by claim 1, wherein:

the adapter and the ambulatory air member are elongated tube-like members, and the adapter is flexible and has a slot extending along the entire length thereof, and is diametrically sized relative to the ambulatory aid member so that as it fits over the ambulatory aid member its radial sides spread, with the adapter thereafter hugging the ambulatory aid member.

3. An ambulatory aid member as described by claim 1, wherein:

the adapter and the ambulatory aid member are elongated tube-like members;

the ambulatory aid member is of a length greater than the distance between the shell ends; and the adapter is of a length greater than the distance between the shell ribs but less than the distance between the shell ends.

4. A handgrip as described by claim 1, wherein:

the shell is transversely concave and tapers longitudinally in a smooth curve from a relatively wide rear end to a relatively narrow front end, said rear and front ends being separated by an intermediate section;

the relatively wide rear end is curved higher than the intermediate section and the relatively narrow front end is curved higher than the intermediate section and the relatively wide rear end;

the intermediate section has a longitudinal bulge; and said concavity, tapering, curving and bulging cooperating to longitudinally and transversely contour the shell for providing the external cradle for the gripping hand.

5. A handgrip as described by claim 4, wherein:

the relatively narrow front end has a lip extending substantially normal to the axis of the shell on one side thereof and a flare on the other side; and the forefinger of the gripping hand engages the lip while the thumb of said hand engages the flare.

6. A handgrip as described by claim 5, wherein the shell is in one configuration of a right hand and left hand configuration; and the lip extends rightward substantially normal to the axis of the shell when the shell is in the right hand configuration, and leftward substantially normal to the axis of the shell when the shell is in the left hand configuration.

* * * * *